United States Patent [19]

Varner

[11] Patent Number: 5,026,300

[45] Date of Patent: Jun. 25, 1991

[54] KIT, METHOD AND PLUG-RECEPTACLE ARRANGEMENT

[76] Inventor: Charles J. Varner, 805 Paradise La., Libertyville, Ill. 60048

[21] Appl. No.: 488,987

[22] Filed: Mar. 5, 1990

[51] Int. Cl.[5] ..... H01R 13/62

[52] U.S. Cl. ..... 439/371; 439/373

[58] Field of Search ..... 439/367, 368, 369, 370, 439/371, 936, 296, 373

[56] References Cited

U.S. PATENT DOCUMENTS

| | | | |
|---|---|---|---|
| 2,759,160 | 8/1956 | Kelly . | |
| 3,543,218 | 11/1970 | Archer | 439/371 |
| 3,585,569 | 6/1971 | Moran . | |
| 4,343,525 | 8/1982 | Knickerbocker . | |
| 4,463,999 | 8/1984 | Knickerbocker . | |
| 4,556,185 | 1/1986 | Bryan et al. | 439/371 |
| 4,690,476 | 9/1987 | Morgenrath . | |
| 4,768,974 | 9/1988 | Cowan et al. . | |
| 4,917,626 | 4/1990 | Barton | 439/371 |

*Primary Examiner*—David L. Pirlot
*Attorney, Agent, or Firm*—Wood, Phillips, Mason, Recktenwald & Van Santen

[57] ABSTRACT

In order to enhance the releasable securement of a plug to a receptacle, a kit, method and plug-receptacle arrangement is disclosed. The kit includes a pair of generally disc-like securing members, each of which includes a thin substrate having a plurality of holes therein, sized and arranged in mirror image fashion to receive a plurality of prongs on the plug. Each of the securing members also includes a releasable engagement arrangement and is adapted to the permanently secured to a respective one of the plug and receptacle. The method includes the steps of providing a pair of substantially identical releasably engaged disc-like securing members wherein the securing members are placed onto the prongs of the plug which is then fully interconnected with the receptacle to cause the securing members to adhere to the plug and receptacle, respectively. The plug is then disconnected from the receptacle following which the securing members are pressed to cause the securing members to fully adhere to the plug and receptacle. The plug-receptacle arrangement includes a first generally disc-like securing member on a receptacle-facing surface of the plug and a second generally disc-like securing member on a plug-facing surface of the receptacle. The securing members are permanently secured to the plug and receptacle by having a retention force greater than a retention force of the securing members to one another. With the kit, method and plug-receptacle arrangement, the releasable securement of a plug to a receptacle is significantly enhanced.

9 Claims, 2 Drawing Sheets

KIT, METHOD AND PLUG-RECEPTACLE ARRANGEMENT

BACKGROUND OF THE INVENTION

The present invention is generally directed to plugs and receptacles and, more particularly, a unique way of enhancing the releasable securement of a plug to a receptacle.

BACKGROUND OF THE INVENTON

A common problem encountered with plugs and receptacles is that they sometimes are inadvertently disconnected when they are in use delivering electrical power. This is true wherever a plug and receptacle are joined, e.g., where the plug of an appliance or tool is directly interconnected with the receptacle in a wall outlet or where two or more extension cords are interconnected by means of the plug of one being inserted into the female socket or receptacle of another. In either case, it is well known that a pulling force on a cord may easily cause the plug and receptacle to become disconnected thereby terminating electrical power.

In some instances, this can be a significant problem as can be appreciated by those in certain occupations. For instance, it is common knowledge that construction workers must frequently resort to utilization of multiple extension cords connected end-to-end in order to provide power for tools in remote locations or locations having difficult accessibility such as rooftops and the like. For such applications, it is very time consuming and extremely frustrating to repeatedly lose power.

In other applications, the possible inadvertent separation of a plug and receptacle can be a significant hazard. For instance, where life support equipment may be electrically interconnected with a wall outlet, an inadvertent force on the cord leading from such equipment could ultimately have tragic consequences. As a result, it is sometimes important to be able to enhance the securement of interconnected plugs and receptacles.

In fact, there is still another reason why this is most important. It is well known that children develop a fascination with plugs and receptacles, and, in fact, it is equally well known that parents are encouraged to utilize false plastic plugs in unused receptacles in wall outlets since children oftentimes have been seriously injured or killed by electrical shock due to insertion of metallic objects into such open receptacles. However, there has been far less attention directed to an equally dangerous situation.

More specifically, children often attempt to disconnect plugs from receptacles. Any such attempt may result in only a partial disconnection of a plug from a receptacle but to a degree where electrical power is still flowing through the plug. When this occurs, the child could be electrocuted by contact with the prongs of the plug.

What makes all of the foregoing problems of even greater concern is the known deterioration factor, i.e., the fact that the prongs of a plug and the electrical contacts within a receptacle gradually lose their retention characteristics. These components initially are quite resilient, but, over time, lose some of their resiliency and consequently their ability to firmly maintain an interconnection therebetween. When this occurs, the electrical interconnection may seriously deteriorate and the plug may far more easily be unintentionally removed from the receptacle when there is even a slight force on a cord.

In the past, there have been a number of attempts to solve one or more of the foregoing problems. Among these are the various approaches taken in U.S. Pat. Nos. 4,768,974; 4,690,476; 4,566,185; 4,463,999; 4,343,525; 3,585,569; 3,543,218; 2,759,160. However, all of these suffer from one or more defects that have made them less than commercially acceptable.

The present invention is directed to overcoming one or more of the foregoing problems and achieving the resulting objects.

SUMMARY OF THE INVENTION

It is therefore an object of the present invention to provide a unique kit, method and plug-receptacle arrangement. It is a further object of the present invention to provide for enhancement of the releasable securement of a plug to a receptacle. It is still another object of the present invention to releasably secure a plug to a receptacle in an economical manner.

An exemplary embodiment of the invention comprises a kit for enhancing the releasable securement of a plug to a receptacle. The kit includes a pair of generally disc-like securing members. Each of the securing members includes a thin substrate having a plurality of holes therein sized and arranged to matingly receive a plurality of prongs on the plug. Each of the securing members also includes complementary releasable engagement means on one surface of the substrate for enhancing the releasable securement of the plug to the receptacle. Each of the securing members further includes means on the other surface of the substrate for permanently securing the substrate to a respective one of the plug and receptacle. The kit is such that the holes are arranged in mirror image fashion. With this arrangement, the kit is well suited for enhancing the releasable securement of a plug to a receptacle.

Additional details of the kit include the thin substrate comprising a cloth-like material and the releasable engagement means comprising hooks and loops. The hooks and loops are provided on corresponding surfaces of the substrates and the permanent securing means can include an adhesive on corresponding surfaces of the substrates. When an adhesive is utilized, a removable backing material is advantageously placed over the adhesive for removal by the end user.

As for the method, it includes the step of providing a pair of substantially identical releasably engaged disc-like securing members each having a plurality of holes therein sized and arranged in mirror image fashion to matingly receive a plurality of prongs on the plug. The releasably engaged securing members are then placed on the prongs of the plug such that the prongs extend through the holes therein. Next, the plug and receptacle are fully interconnected by completely inserting the prongs of the plug into prong-receiving openings in the receptacle to cause a permanent securement surface of each of the securing members to adhere to respective ones of the plug and receptacle. The releasable engaged securing members then adhere to a receptacle-facing surface of the plug and a plug-facing surface of the receptacle. With this understanding, the method also advantageously includes the step of disconnecting the plug from the receptacle to thereby separate the securing members and thereafter pressing on a releasable engagement surface of each of the securing members to cause the permanent securement surfaces to fully adhere to the plug and receptacle.

In a highly preferred form of the method, a separation strip is provided between the securing members and a backing material is removed from the permanent securement surfaces of the securing members before the interconnecting step.

Finally, the plug-receptacle arrangement includes a first generally disc-like securing member on a receptacle-facing surface of the plug and a second generally disc-like securing member on a plug-facing surface of the receptacle. Each of the securing members comprises a thin substrate substantially permanently secured to a respective one of the plug and the receptacle. The securing member on the receptacle-facing surface of the plug has a plurality of holes therein and is sized and arranged to substantially entirely cover the receptacle-facing surface with a plurality of prongs on the plug extending through the holes. The securing member on the plug-facing surface of the receptacle has a like plurality of holes therein and is sized and arranged to conform to the securing member on the receptacle-facing surface of the plug to permit insertion of the prongs into prong-receiving openings in the receptacle. Each of the securing members also includes a complementary releasable engagement means on confronting surfaces of the substrates. With this arrangement, the plug-receptacle arrangement is also such that the releasable engagement means is adapted to enhance the releasable securement of the plug to the receptacle.

Advantageously, the thin substrates are substantially permanently secured to the plug and the receptacle with an adhesive. The releasable engagement means can then include hooks and loops on confronting surfaces of the substrates. When so configured, the adhesive has a retention force greater than the retention force of the hooks and loops.

Other objects, advantages and features of the present invention will become apparent from a consideration of the following specification taken in conjunction with the accompanying drawings.

DETAILED DESCRIPTION OF THE PREFERRED EMBODIMENT

Figure 1:
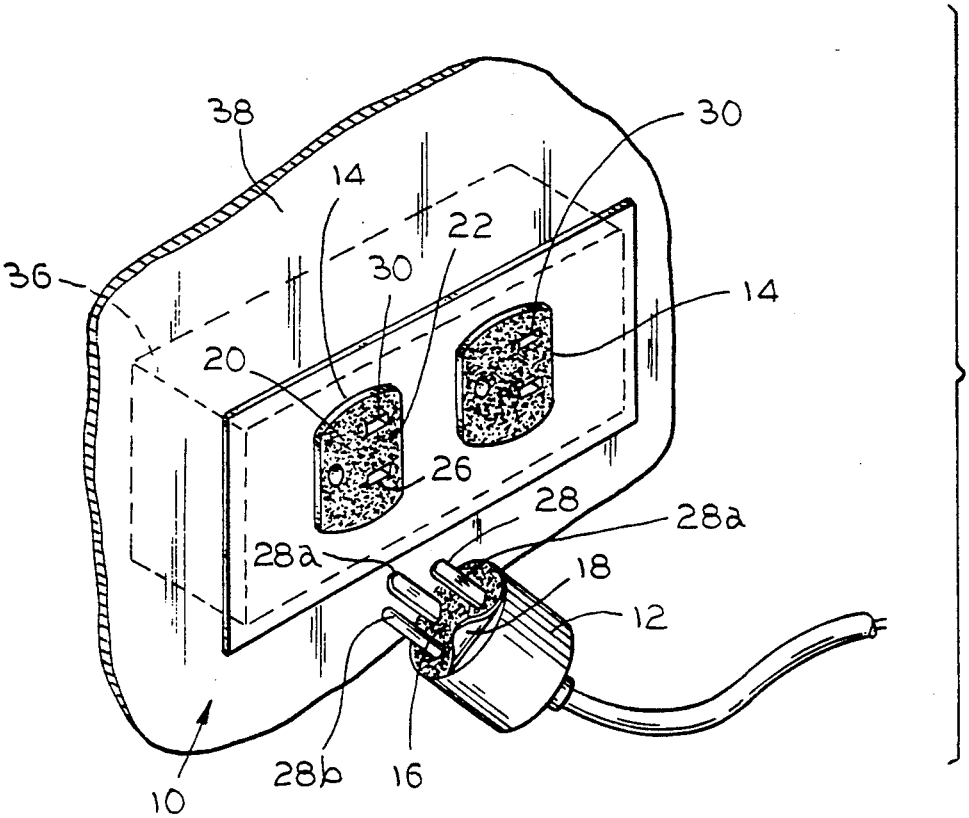
FIG. 1 is a perspective view of a plug-receptacle arrangement in accordance with the present invention.
Figure 2:
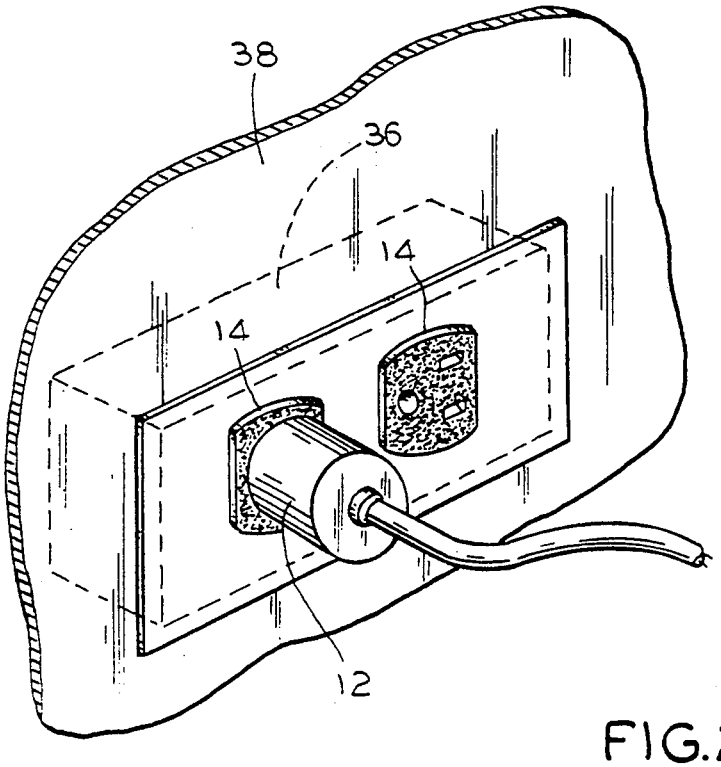
FIG. 2 is a perspective view similar to FIG. 1 with the plug inserted into the receptacle.
Figure 6:
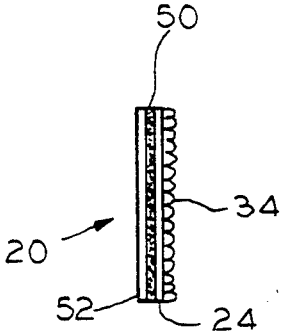
FIG. 6 is a cross sectional view of one form of disc-like securing member such as that shown in FIG. 5.
Figure 7:
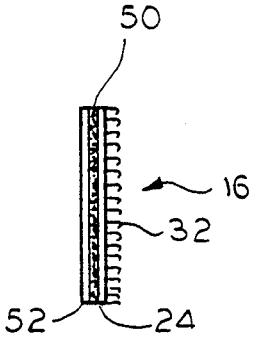
FIG. 7 is a cross sectional view of another form of disc-like securing member such as that illustrated in FIG. 5.

Referring to the drawings, and first to FIG. 1, the reference numeral 10 designates generally a plug-receptacle arrangement wherein a plug 12 is to be releasably secured to a receptacle 14. The plug-receptacle arrangement 10 includes a first generally disc-like securing member 16 on a receptacle-facing surface 18 of the plug 12 and a second generally disc-like securing member 20 on a plug-facing surface 22 of the receptacle 14. Each of the securing members 16 and 20 comprise a thin substrate 24 (see FIGS. 6 and 7) permanently secured to a respective one of the plug 12 and receptacle 14. The securing member 16 on the receptacle-facing surface 18 of the plug 12 has a plurality of holes 26 therein and is sized and arranged to substantially entirely cover the receptacle-facing surface 18 with a plurality of prongs 28 on the plug 12 extending through the holes 26. The securing member 20 on the plug-facing surface 22 of the receptacle 14 has a like plurality of holes 26 therein and is sized and arrange to conform to the securing member 16 on the receptacle-facing surface 18 of the plug 12 to permit insertion of the prongs 28 into prong-receiving openings 30 in the receptacle 14. Each of the securing members 16 and 20 also include complementary releasable engagement means such as hooks 32 and loops 34 (see FIGS. 6 and 7) on confronting surfaces of the substrates 24. The plug-receptacle arrangement 10 is such that the hooks 32 and loops 34 are adapted to enhance the releasable securement of the plug 12 through the receptacle 14 when the plug 12 has been inserted into receptacle 14 as illustrated in FIG. 2. While FIGS. 1 and 2 illustrate a typical receptacle 14 in a junction box 36 mounted in a wall 38, this represents only one of many uses of the present invention.

Figure 3:
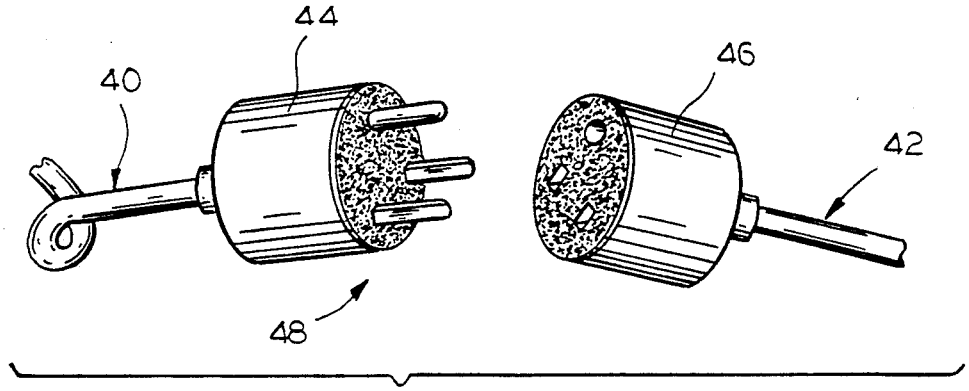
FIG. 3 is a perspective view of another plug-receptacle arrangement in accordance with the present invention.
Figure 4:
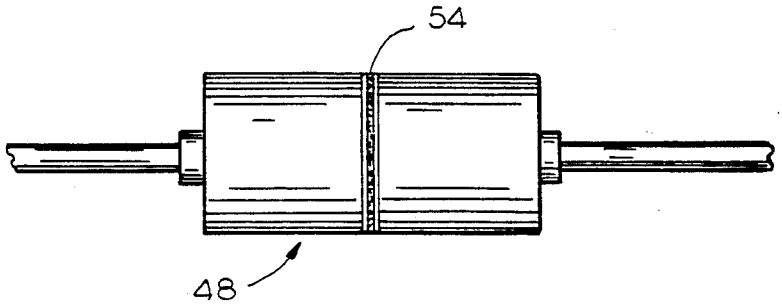
FIG. 4 is a perspective view similar to FIG. 3 with the plug inserted into the receptacle.

For instance, it will be seen and appreciated that FIGS. 3 and 4 illustrate the ends of two separate extension cords 40 and 42. The extension cord 40 has a plug 44 on one end adapted to be electrically interconnected with the receptacle 46 on one end of the extension cord 42. However, the resulting plug-receptacle arrangement 48 is well suited for enhancing the releasable securement of the plug 44 to the receptacle 46.

For both the plug-receptacle arrangement 10 and the plug-receptacle arrangement 48, the thin substrate 24 is preferably a cloth-like material. This cloth-like material 24 is well suited for carrying the hooks 32 and loops 34 in the manner of the product sold under the trademark "VELCRO", and the cloth-like material 24 is adapted to be substantially permanently secured to a plug such as 12, 44 or the like and a receptacle such as 14, 46 or the like with an adhesive 50 on the surface of the cloth-like material 24 opposite that carrying the hooks 32 and loops 34. With this arrangement, a removable backing material 52 initially protects the adhesive 50 which is selected to have a retention force greater than the retention force of the hooks 32 and loops 34.

As should now be appreciated, the present invention is well suited to be provided as a kit for enhancing the releasable securement of a plug 12, 44, etc. to a receptacle 14, 46, etc. The kit will comprise a pair of generally disc-like securing members 16 and 20. Each of the securing members 16 and 20 will comprise a thin substrate 24 having a plurality of holes 26 therein sized and arranged to matingly receive a plurality of prongs 28 on the plug 12, 44, etc. Each of the securing members 16 and 20 will also include complementary releasable engagement means such as the hooks 32 and loops 34 on one surface of the substrate 24 for enhancing the releasable securement of the plug 12, 44, etc. to the receptacle 14, 46, etc. Each of the securing members will further include means such as adhesive 50 on the other surface of the substrate 24 for permanently securing the substrate 24 to a respective one of the plug 12, 44, etc. and receptacle 14, 46, etc. The kit 10 is also such that the holes 26 are arranged in mirror image fashion as will be required.

In the illustrated embodiment (see FIG. 5), the holes 26 include a pair of holes 26a of a first configuration and a hole 26b of a second configuration to accommodate a standard plug 12. In this connection, it will be appreciated that the standard plug 12 has a pair of prongs 28a adapted to carry electricity and another prong 28b which serves as a ground. With this well known arrangement, the holes 26a are generally rectangular to conform to the generally rectangular prongs 28a and the hole 26b is generally circular to conform to the generally circular prong 28b.

As will be known by those skilled in the art, there are a wide variety of different types of prong and receptacle configurations. Thus, the securing members 16 and 20 can be provided with different hole patterns sized and arranged to conform to each of the multitude of types of plug and receptacle arrangements. In this manner, the present invention can be sold as a kit where the consumer is able to select the appropriate securing members 16 and 20.

As will also be appreciated, plugs come in a wide variety of different sizes and shapes apart from the configurations of the prongs. It is believed most practical to provide the disc-like securing members 16 and 20 in a generally circular configuration of sufficient size and shape to accommodate all such plugs and receptacles whereby the excess may trimmed, if desired, to conform to the shape for a particular application. Due to the nature of the material of the securing members 16 and 20, this is easily accomplished with the use of scissors or a utility knife.

Additionally, it may well be considered advantageous for the securing members 16 and 20 to be provided in different colors. This will assist the user inasmuch as it is preferable to always provide one of the securing members (such the securing member 16 carrying the hooks 32) on plugs and the other of the securing member (such as the securing member 20 carrying the hooks 34) on receptacles. In this manner, the user can take advantage of the attributes of the present invention by using any plug in any receptacle.

Referring to FIG. 4 where the plug 44 has been fully inserted into the receptacle 46, it will be seen that the securing members 16 and 20 are sufficiently thin so as not to disrupt power flow. They have, of course, been shown with an exaggerated thickness in FIGS. 6 and 7 for purposes of illustrating the composite structure thereof. However, when the plugs 12, 44, etc. are fully inserted into the receptacles 14, 46, etc., the interface such as 54 (see FIG. 4) between the plug and receptacle is of an axially limited length.

In accordance with the present invention, a unique method of enhancing the releasable securement of a plug to a receptacle has been achieved. The method includes the step of providing a pair of substantially identical releasably engaged disc-like securing members 16 and 20 each having a plurality of holes 26 therein sized and arranged in mirror image fashion to matingly receive a plurality of prongs 28 on the plug 12, 44, etc. The releasably engaged securing members 16 and 20 are then placed on the prongs 28 of the plug 12, 44, etc. such that the prongs 28 extend through the holes 26. Next, the method includes the step of fully interconnecting the plug 12, 44, etc. and the receptacle 14, 46, etc. by completely inserting the prongs 28 of the plug 12, 44, etc. into prong-receiving openings such as 30 in the receptacle 14, 46, etc. to cause a permanent securement surface carrying the adhesive 50 of each of the securing members 16 and 20 to adhere to respective ones of the plug 12, 44, etc. and receptacle 14, 46, etc. The releasably engaged securing members 16 and 20 are then adhered to a receptacle-facing surface such as 18 of the plug 12, 44, etc. and a plug-facing surface such as 22 of the receptacle 14, 46, etc. With this understanding, the method also advantageously includes the step of disconnecting the plug 12, 44, etc. from the receptacle 14, 46, etc. to thereby separate the securing members 16 and 20 and thereafter pressing on a releasable engagement surface 32 and 34 of each of the securing members 20 and 16 to cause the permanent securement surfaces carrying the adhesive 50 to fully adhere to the plug 12, 44, etc. and receptacle 14, 46, etc.

When the securing members 16 and 20 carry a backing material 52, the method also includes the step of removing the backing material 52 from the permanent securement surfaces carrying the adhesive 50 before interconnecting the plug 12, 44, etc. and receptacle 14, 46, etc. Also, when the securing members 16 and 20 include a separation enhancement strip 56, the method includes the step of removing the separation strip 56 from the releasable engagement surface of one of the securing members 16 and 20 after the disconnecting step.

Figure 5:
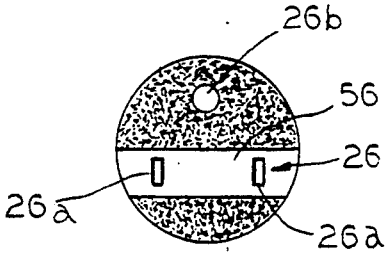
FIG. 5 is a front elevational view of a disc-like securing member in accordance with the present invention.

As shown in FIG. 5, the separation enhancement strip 56 can be formed of a material such as paper. This separation enhancement strip 56 preferably covers a portion of the surface of the securing members 16 and 20 such that, when the securing members 16 and 20 are releasably engaged prior to use, the consumer can more easily overcome the retention force of the hooks 32 and loops 34 to separate the securing members 16 and 20. Of course, it is then possible to proceed with the installation procedure set forth hereinabove.

In order to properly utilize the present invention, the appropriate surfaces of the plug and the receptacle are cleaned and dried in a thorough manner. The securing members 16 and 20 will typically come in engaged fashion within a package and they will be utilized such that one color of securing member, e.g., beige and having the loops 34 is installed on the receptacle while the other of the colored securing members, e.g., white and having the hooks 32 is installed on the plug. As previously mentioned, the securing members may be trimmed after installation for irregularly shaped plugs and/or receptacles.

As will now be appreciated, the present invention achieves the objects set forth hereinabove. It is well suited for a multitude of applications requiring enhancement of the releasable securement of a plug to a receptacle. In a unique manner, the kit, method and plug-receptacle arrangement enhances safety, convenience and reliability.

While in the foregoing there have been set forth preferred embodiments of the invention, it will be appreciated that the details herein given may be varied by those skilled in the art without departing from the true spirit and the scope of the appended claims.

I claim:

1. A kit for enhancing the releasable securement of a plug to a receptacle, comprising:

a pair of generally disc-like securing members, each of said securing members including a thin substrate having a plurality of holes therein sized and arranged to matingly receive a plurality of prongs on said plug, said securing members also including complementary releasable engagement means comprising hooks on one surface of one of said substrates and loops on a corresponding surface of the other of said substrates for enhancing the releasable securement of said plug to said receptacle, each of said securing member further including means on the surface of said substrate opposite said releasable engagement means for permanently securing said substrate to a respective one of said plug and receptacle, said holes being arranged in mirror image fashion; and means intermediate said hooks and loops for facilitating separation of said securing members.

2. The kit as defined in claim 1 wherein said thin substrate of said pair of generally disc-like securing members is a cloth-like material.

3. The kit as defined in claim 1 wherein said permanent securing means includes an adhesive on corresponding surfaces of said substrates.

4. The kit as defined in claim 3 including a removable backing material on said adhesive on corresponding surfaces of said substrates.

5. A method of enhancing the releasable securement of a plug to a receptacle, comprising the steps of:

providing a pair of substantially identical releasably engaged disc-like securing members each having a plurality of holes therein sized and arranged to matingly receive a plurality of prongs on said plug in mirror image fashion, and a separation strip between said securing members, each of said securing members comprising a thin substrate having a releasable engagement surface on the side opposite said permanent securement surface with hooks and loops thereon, respectively;

placing said releasably engaged securing members on said prongs of said plug such that said prongs extend through said holes;

fully interconnecting said plug and receptacle by completely inserting said prongs of said plug into prong-receiving openings in said receptacle to cause a permanent securement surface of each of said securing members to adhere to respective ones of said plug and receptacle; and disconnecting said plug from said receptacle to thereby separate said securing members and thereafter pressing on a releasable engagement surface of each of said securing members to cause said permanent securement surfaces to fully adhere to said plug and receptacle;

said securing members adhering to a receptacle-facing surface of said plug and a plug-facing surface of said receptacle.

6. The method of claim 5 including the step of removing a backing material from said permanent securement surfaces of each of said securing members before performing said plug and receptacle interconnecting step.

7. The method of claim 5 wherein said thin substrate of each of said securing members is formed of a cloth-like material.

8. The method of claim 5 wherein said permanent securement surfaces each include an adhesive.

9. The method of claim 5 including the step of removing said separation strip after said disconnecting step.

* * * * *